US006966971B1

(12) United States Patent
Sellars et al.

(10) Patent No.: US 6,966,971 B1
(45) Date of Patent: Nov. 22, 2005

(54) ABSORBENT WIPE HAVING BONDING MATERIAL LOGO

(75) Inventors: John C. Sellars, Wauwatosa, WI (US); William R. Sellars, Milwaukee, WI (US); Richard R. Hepford, Sebastian, FL (US)

(73) Assignee: Sellars Absorbent Materials, Inc., Milwaukee, WI (US)

( * ) Notice: Subject to any disclaimer, the term of this patent is extended or adjusted under 35 U.S.C. 154(b) by 112 days.

(21) Appl. No.: 10/133,262

(22) Filed: Apr. 26, 2002

Related U.S. Application Data

(63) Continuation-in-part of application No. 09/999,151, filed on Oct. 31, 2001, now abandoned.

(51) Int. Cl.[7] ..... B31F 1/12; D12H 11/00; D12H 13/00

(52) U.S. Cl. ..... 162/112; 162/111; 162/134; 162/135; 428/171; 428/172; 264/128; 264/136

(58) Field of Search ..... 162/112, 111, 134, 162/135; 428/171, 172; 264/128, 136

(56) References Cited

U.S. PATENT DOCUMENTS

| | | | | |
|---|---|---|---|---|
| 3,879,257 | A | 4/1975 | Gentile et al. | |
| 3,903,342 | A | 9/1975 | Roberts, Jr. | |
| 3,940,529 | A | 2/1976 | Hepford et al. | |
| 4,000,237 | A | 12/1976 | Roberts, Jr. | |
| 4,135,024 | A * | 1/1979 | Callahan et al. | 428/171 |
| 4,208,459 | A | 6/1980 | Becker et al. | |
| 4,429,014 | A | 1/1984 | Isner et al. | |
| 4,507,173 | A | 3/1985 | Klowak et al. | |
| 4,612,231 | A | 9/1986 | Bouchette et al. | |
| 4,618,524 | A | 10/1986 | Groitzsch et al. | |
| D383,003 | S | 9/1997 | Hepford | |
| 5,776,306 | A | 7/1998 | Hepford | |
| 5,989,682 | A | 11/1999 | Anderson | |
| 6,060,149 | A | 5/2000 | Nissing et al. | |
| 6,096,152 | A | 8/2000 | Anderson et al. | |
| 6,103,061 | A | 8/2000 | Anderson et al. | |
| 6,129,815 | A | 10/2000 | Larson et al. | |
| 6,129,972 | A | 10/2000 | McNeil et al. | |
| 6,149,768 | A | 11/2000 | Hepford | |

* cited by examiner

*Primary Examiner*—Mark Halpern
(74) *Attorney, Agent, or Firm*—Fredrikson & Byron, PA

(57) ABSTRACT

An absorbent printed paper web and methods for making the printed web, the web having a visually discernible larger pattern, which can be a logo, on at least one surface formed essentially only of a paper web and a strengthening, colored bonding material. The printed web having the larger pattern can be made using the same bonding material and process used to print the background pattern. A double recrepe process using an improved Gravure roll may be used to print both logo and background. One method includes using a Gravure roll having deep depressions for printing a geometric background pattern, which can be a cross hatch pattern defining unprinting surface areas between the repeating deep depressions. The Gravure roll can also have shallow depressions in the reverse image of a logo to be printed, where the shallow depressions can have contiguous logo areas much larger than the size of the repeating deep depressions or unprinting surface areas in the background pattern. The shallowly printed regions add strength, and due to interaction with the creping roll and blade, also add bulk and softness to the finished web. The printed web can be printed with a Latex bonding material on one or both web surfaces, not requiring further web printing and compression on a surface after creping. The resulting printed web can carry a product or service logo or trademark, while being strengthened and expanded by the bonding material which also carries the logo or trademark.

27 Claims, 9 Drawing Sheets

ABSORBENT WIPE HAVING BONDING MATERIAL LOGO

RELATED APPLICATIONS

The present application is a continuation-in-part of U.S. patent application Ser. No. 09/999,151, now abandoned, entitled ABSORBENT WIPE HAVING BONDING MATERIAL LOGO, filed Oct. 31, 2001, herein incorporated by reference.

FIELD OF THE INVENTION

The present invention relates generally to absorbent, fibrous web materials that can include paper making fibers. More specifically, the present invention relates to paper webs strengthened with the application of bonding material patterns. The present invention can include using a double recrepe process to form colorfast, larger bonding material patterns set against repeating smaller background patterns, without requiring a subsequent printing step.

BACKGROUND OF THE INVENTION

Disposable, absorbent paper products have been developed to replace more conventional cloth products. These products include facial tissues, paper towels, towels, and wipers or wipes. The wipers or wipes may be intended primarily for use in commercial, industrial, or other harsh and/or demanding applications requiring strength.

For many applications, disposable absorbent paper products ideally simulate cloth in appearance, perception, and performance. Desirable physical properties include softness, strength, stretchability, absorbency, ability to wipe dry, bulk, and resistance to abrasion. The properties required of a wipe will depend on the intended use of the product. Softness is a desirable property for most absorbent paper products. End users find soft products more pleasant to handle. The softness also enables products to conform to the shape that is required by the application. Strength and stretchability are other desirable properties, particularly for products that are to be used for industrial applications.

It may also be desirable for a product to have good abrasion resistance, if it is to be used for wiping, scouring, or cleaning. Even for facial tissue, poor abrasion resistance can result in pilling or dusting of fibers from the tissue when handled by the consumer. Bulk is also important as it enables the paper web product to resemble cloth in feel, and also because it generally adds to softness and absorbency.

Some paper web properties are often inversely related. An increase in one may often be accompanied by a decrease in the other. In one example, an increase in web density or fiber concentration increases the ability of the web to wipe dry or pick up moisture, due to increased capillary action within small spaces between the fibers. Unfortunately, the increase in closeness of the fibers also decreases the space between the fibers that is available for holding moisture, thereby reducing the absorbency of the product. Strength and softness may also be inversely related. Methods which produce soft paper often result in strength reduction. This is generally true because the principal source of web strength is the inter-fiber bonds formed by the hydrate bonding processes associated with papermaking. Paper having a heavy concentration of these bonds is generally stiff. To soften the paper, it is generally necessary to reduce the stiff bonds, which often results in a loss of strength.

One method commonly used to reduce the stiff papermaking bonds is to crepe the paper from a drying surface using a doctor blade, thereby disrupting and breaking many of the inter-fiber bonds in the paper web. Other methods used to reduce the bonds include chemical treatment of the papermaking fibers to further reduce the inter-fiber bonding capacity. These methods generally reduce the strength of the papermaking bonds.

Some processes restore the strength loss by reducing the papermaking bonds, by adding bonding materials to the web. The bonding materials are capable of adding strength more than they add stiffness. In one method, the bonding material is added to the aqueous slurry of fibers and deposited on the web forming surface along with the fibers. This method, however, reduces the absorbency of the web as it fills the pores between the fibers with bonding material.

In another method, bonding material is applied to the web in a spaced apart, geometrically regular pattern on the web. In this method, the majority of the web surface is free of the bonding material, leaving the majority of the surface highly absorbent. As the papermaking fibers are often less than about one quarter of an inch long, it is often desirable to have the bonding material applied in a pattern, repeated at intervals less than the average papermaking fiber length. Any harshness in the bonded areas may be reduced by tightly adhering the bonded portions of the web to a creping surface and removing the web with a doctor blade, thereby finally creping the bonded portions to soften those portions of the web.

Attempts have been made to apply decorative or commercial messages onto paper web products, including those products strengthened with patterns of bonding material. In one method, larger, foreground patterns have been printed with ink onto paper web products. In one such method, the decorative patterns are printed with ink in a secondary process, after the paper web products have been previously printed with bonding material background patterns and creped, in a primary process. The secondary printing process requires further processing the web, including running the web through additional rolls and nips. The secondary process also requires additional capital equipment, processing time, and labor. In addition, the secondary process can compress the printed web, at least partially degrading desirable properties, such as softness and bulk, which were previously imparted by the primary process.

The printed ink designs made using the secondary process are often not colorfast, and may run. In some applications, wipes may be used for commercial purposes, such as cleaning products for sale, or cleaning commercial buildings for use. Industrial or cleaning solvents may be used with the wipes. The wipes, which may also be laden with aggressive solvent, can cause the logo ink color to be left behind on the wiped commercial products and commercial building surfaces. This is undesirable.

What would be desirable, is a method for forming large patterns onto paper web products which are also strengthened with bonding material, without causing the pattern colors to bleed over the surfaces wiped. It would be most advantageous to form the logo pattern and any background pattern in the same process, not requiring a second printing step.

SUMMARY OF THE INVENTION

The present invention includes methods of making bonded and creped absorbent paper webs. A double recrepe process can be used to print a larger, colorfast pattern on a smaller, repeating background pattern, utilizing improved Gravure rolls made according to the present invention. The present invention can provide a large pattern printed against a background pattern using the same roll and process for both. The large pattern can be a logo or brand. The present invention thus provides methods for printing a large pattern against a background pattern, without requiring a second process apart from the process used to form the background pattern. Such a second process can compress the previously creped web, and can degrade the bulk and softness added by the creping. The present invention can provide large printed patterns, without requiring printing a web surface after the surface has been creped. The present invention can provide large, colorfast patterns formed of colored bonding material. The bonding material can have pigment or colorant encapsulated in the bonding material to give a colorful, colorfast, bonding material.

One method includes providing a paper web having a first surface and a second surface. A first Gravure roll can be provided that has been engraved with a plurality of regular, repeating, deep depressions surrounding a plurality of non-printing, substantially flat roll regions. The first Gravure roll can further have a plurality of shallow roll depressions having a depression depth less than the deep roll depressions. The shallow roll depression regions preferably have a contiguous square area substantially larger than the non-printing roll regions defined by the surrounding regular, repeating deep depression pattern regions. A bonding material can be printed onto the web first surface by pressing the Gravure roll and bonding material against the web first surface, such that a deeply penetrating background pattern of bonding material is forced into the web by the roll deep depressions. Unprinted web regions are formed by the flat, non-printing roll regions. In some printed webs, the background pattern includes two sets of numerous parallel lines, the two sets intersecting each other to form numerous rectangular unprinted regions therebetween, forming a checked pattern. The unprinted regions thus formed have an average size defined by, and approximately equal to, the size of the enclosing four lines forming the background pattern.

A plurality of foreground patterns having a logo therein can be formed by the roll shallow depression regions. The roll shallow depression regions may force the bonding material into the shallowly penetrating bonding material regions. The Gravure roll thus prints onto the web first surface a series of repeating, deeply penetrating bonding material patterns having non-printed regions defined therebetween. The Gravure roll also forms a number of shallowly penetrating bonding material regions having a larger average contiguous area size than the repeating background pattern and the repeating non-printed area size. In one embodiment, the background, deeply penetrating bonding material background regions have a depth of at least about 150 percent that of the shallowly penetrating bonding material logo regions.

In some embodiments, the shallowly penetrating, contiguous logo areas are at least about four times the average repeating geometric background area and are at least about four times the average repeating unprinted web area. In a preferred embodiment, the shallowly penetrating bonding material region includes a visually recognizable symbol, which is more preferably a trademark or logo. In a preferred embodiment, the second surface of the web is imprinted with a deeply penetrating, regular, background pattern which can be similar to the deeply penetrating, background pattern on the first surface. In a preferred embodiment, the second surface of the web has no shallow penetrating logo or other visually discernable symbols thereon. After creping, the web is expanded or exploded due to the adhering of the bonding material to the creping drum and subsequent action of the doctor or creping blade. The web has softness and bulk imparted both near the deeply printed regions and the shallowly printed regions. The areas having the shallow printing thus have structural properties imparted in addition to any design.

In one embodiment, the deeply penetrating bonding material regions penetrate between about 10 percent and 40 percent of the web thickness, with the shallowly penetrating regions penetrating less than about 50 percent of the deeply penetrating regions. In some embodiments, a polymeric material is included in the bonding material. In a preferred embodiment a latex based material containing pigment is used as the bonding material.

The printed webs can display logos or other patterns, where the logos or other patterns consist essentially of only the bonding material and the web, not requiring any inks. The logos may be visually set off from the background, or set off from borders surrounding the logos or letters or elements forming the logos. This visual set off can be formed by a bonding material penetration depth difference between the logos, border, and/or background pattern.

Business methods are also within the scope of the present invention. One method includes advertising a product or service of a business entity by imprinting a trademark of that business entity on the disposable and creped absorbent paper web product using a bonding material to form the trademark. In a preferred embodiment, the bonding material used is the same bonding material used to otherwise strengthen the paper web product. The printed web product thus formed can be sold to the business entity or to a third party.

DETAILED DESCRIPTION OF THE PREFERRED EMBODIMENTS

The following detailed description should be read with reference to the drawings, in which like elements in different drawings are numbered identically. The drawings, which are not necessarily to scale, depict selected embodiments and are not intended to limit the scope of the invention. Several forms of invention have been shown and described, and other forms will now be apparent to those skilled in art. It will be understood that embodiments shown in drawings and described above are merely for illustrative purposes, and are not intended to limit scope of the invention as defined in the claims which follow.

Figure 1:
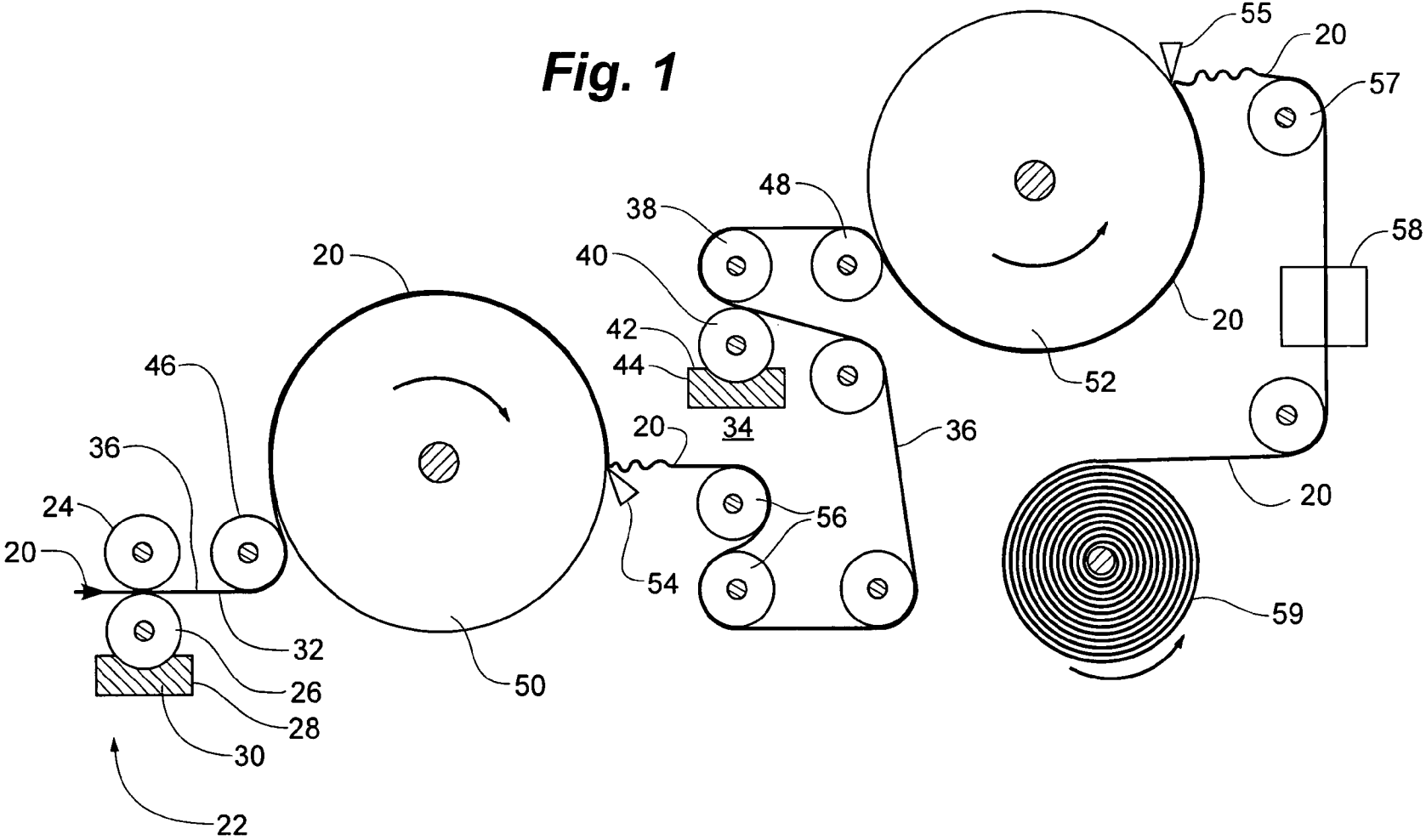
FIG. 1 is a schematic view of a process for imprinting bonding material onto paper webs using equipment including a first Gravure roll, a first drying and creping roll, a second Gravure roll for the web second surface, and a second drying and crepe roll for the web second surface, followed by a take-up roll.

Referring now to FIG. 1, a process and system for applying patterned bonding material to a paper web is illustrated. A relatively standard process may be used to practice the present invention, but with the Gravure rolls being different. A paper web 20 is illustrated entering the process. Web 20 may be formed of papermaking fibers, and can have an average papermaking fiber length of about ¼ inch. In one embodiment, the fibers are Northern Soft Wood Kraft (NSWK) type fibers. In one method, the web has a basis weight of about 35–50 pounds per ream. In another method, the web has a basis weight of about 50 pounds per ream. Web 20 may be seen to have a first surface 32 and a second surface 36.

Web 20 may pass through a nip formed by two rollers, a first rubber press roll 24 and a first rotogravure (Gravure) roll 26. Rubber press roll 24 is preferably formed of a smooth rubber material and Gravure roll 26 is preferably formed of a patterned metal. First Gravure roll 26 may be seen to pass through a bonding material 30 carried within a pan 28 at a first bonding material application station 22. First Gravure roll 26 can have a background pattern of relatively deeper impressions and a foreground pattern of relatively shallower depressions to form a logo or other design thereon. Web 20 may then optionally be passed through a drying station (not illustrated in FIG. 1). After application of the bonding material 30 to a first surface of web 20, web 20 is pressed into contact with a first creping drum 50 by a first press roll 46. Press roll 46 causes the portions of web 20 having bonding material to adhere tightly to the surface of creping drum 50. Web 20 is carried about creping drum 50 and then removed from creping drum 50 by application of a creping doctor blade 54. The doctor blade imparts a series of fine lines or surface serrations to the portions of web 20 which adhered to the creping surface of creping drum 50. The creping action also causes the unbonded, or lightly bonded, fibers in the web to puff up and spread apart, thereby forming web portions having good bulk and softness characteristics. Creping drum 50 can have any surface sufficient to bond the adhesive tightly to the drum and to thereby enable creping of the web 20 from the surface of creping drum 50. In some methods, the surface of creping drum 50 is heated to increase the adhesion of the web to the drum and also to dry the web. In one method, a Yankee dryer is used as the creping drum. Other suitable creping drums known in the art may be used, however.

When the printed web hits the creping or doctor blade, the printed regions, having bonding material, stay bound together. The unprinted regions near the printed regions are pulled apart at the creping blade, leading to decreased density in the unbonded regions. In particular, regions in the center of the web thickness "explode", gaining bulk and width, and losing density, as the nearby bonding material adheres to the creping drum and is pulled off the drum. This is true of the center web material near both the deeply printed background patterns and the shallowly printed, larger, logo patterns.

Web 20, having been controllably creped, may be pulled from the creping doctor blade 54 through a pair of driven pull rolls 56 which control the degree of crepe by the difference in their speeds and the speed of the creping surface. After the first creping, web 20 may be pulled through a nip formed by a second rubber press roll 38 and a second Gravure roll 40. Second Gravure roll 40 may be seen to rotate through bonding material 44 held within a bonding material pan 42, all within a second bonding material application station 34. Second Gravure roll 40 may have a plurality of deep, background pattern impressions thereon, in order to further strengthen the web. In one embodiment, only first Gravure roll 26 has a foreground, shallow logo pattern thereon.

After second surface 36 has been coated with a pattern of bonding material at second station 34, the coated web is pressed to adhere against a second creping roll 52 by a second press roll 48. After being in contact with a second creping roll 52 for a sufficient distance, a second creping doctor blade 55 crepes the second surface 36 of web 20. Web 20 may then be pulled through an optional dryer or curing station 58 before being taken up by a take up spool or parent roll 59.

Figure 2A:
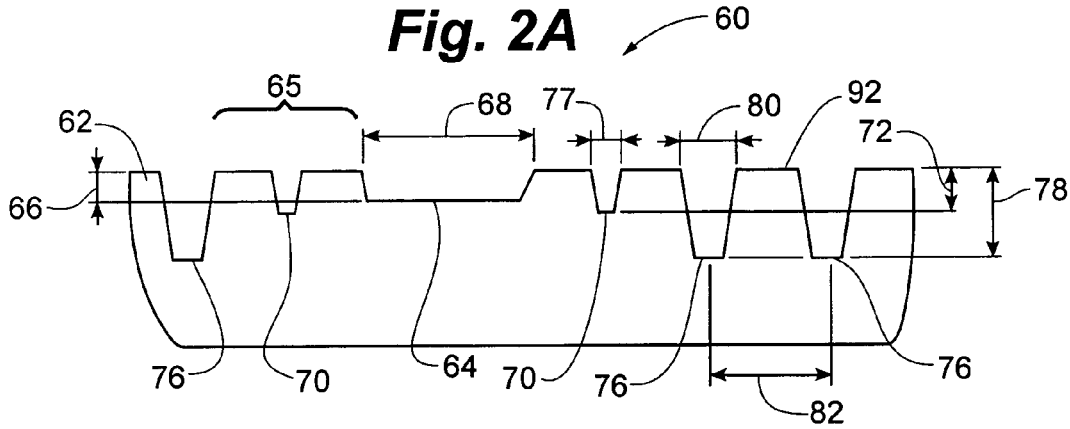
FIG. 2A is a fragmentary, transverse, cross-sectional view of a Gravure roll surface region having a shallow depression for printing a foreground logo pattern disposed between two intermediate depth depressions for forming a strengthening border region about the logo, which is disposed in turn between deep depressions for forming high density, repeating, background patterns of deeply penetrating bonding material in the web.

Referring now to FIG. 2A, a surface sectional portion of a Gravure roll 60 is illustrated. Gravure roll 60 has a surface region 62. Surface region 62 may be seen to have a relatively shallow depression 64 disposed within two intermediate depth depressions 70 further disposed between deep depressions 76. Shallow depression 64 can be used to form a relatively shallow, lower penetrating bonding material region on a web, and can be used to form a rather large logo or other indicia. Intermediate depth depressions 70 can be used to form an intermediate strength border about the logo formed by shallow depression 64, and may not be found in many embodiments of the invention. Deep depressions 76 correspond to deeply penetrating, higher density bonding material regions, which can be used to form regular, background, geometric patterns such as long lines or stripes on the web material that form a diamond or reticular pattern.

As used herein, "logo", when used within the description of making a printed web or the structure of the printed web, refers to a symbol or set of symbols which are visually discernible against a background pattern. As used herein, "density" refers to the sheet density, the weight of a section taken through the sheet within a small area which can have both bonding material and fibers. Within the width of a background line or stripe, the density is defined as being within the line or stripe width all the way through the sheet thickness, not including the unprinted space between lines. Within the letter of a logo, the density is defined as within the strokes forming the letter, not including the unprinted space between strokes. The density in regions deeply penetrated by bonding material is greater than the density in regions shallowly penetrated by bonding material, as the fibers are believed to be more tightly bound together in the regions having more bonding material. Additionally, the shallowly penetrated regions have a thicker "middle" web portion, which "explodes" or expands upon creping more than the deeply penetrated regions, which have less of a web middle to expand.

Shallow depression 64 may be seen to have generally a width 68 and a depth 66. In one embodiment, shallow depression depth 66 is about 40–50 microns. Shallow depression 64 can have a width 68 sufficiently large to form a visually discernible logo or other symbol. In some embodiments, shallow depression width 68 can be between about 2 millimeters and ten millimeters.

Intermediate depression 70 may be seen to have a depth 72 and a width 74. Intermediate depth depression 70 may have depth 72 being between about 60 microns and 70 microns in some embodiments. Intermediate depth depression width 74 may vary across different embodiments. In some embodiments, intermediate depth depression's width 74 may be, in effect, a dot or stippling having a very small width, for example, 0.25 to about 0.75 mm. In other embodiments, width 74 may be larger than about 1 mm. Intermediate depth depression 72 can correspond to an intermediate strength border region 65 formed about the individual symbols or letters forming a logo. Intermediate depth depression 70 may not be present in all embodiments of the invention.

Deep depressions 76 may be seen to have a depth as indicated at 78 and a width as indicated at 80. In some embodiments, deep depression depth 78 may be between about 75 and 80 microns. Deep depression width 80 may be between about 0.5 mm and 1 mm in some embodiments. Deep depressions 76 may be repeated to form a regular, repeating, geometric pattern having a flat region 92 therebetween and a smallest repeating distance as indicated at 82. Regions 92 may be referred to as "flat" even though they are, in fact, non-engraved surface points on the Gravure roll. Viewed very locally, flat regions 92 are substantially flat. FIG. 2A, which is not to scale, includes both the background, repeating interval 82 and the shallow, logo width 68. The logo symbol width 68 can be, for example, the width of the stroke portion of a letter. In a preferred embodiment, shallow depression width 68 is at least about two or four times the background interval distance 82.

Figure 2B:
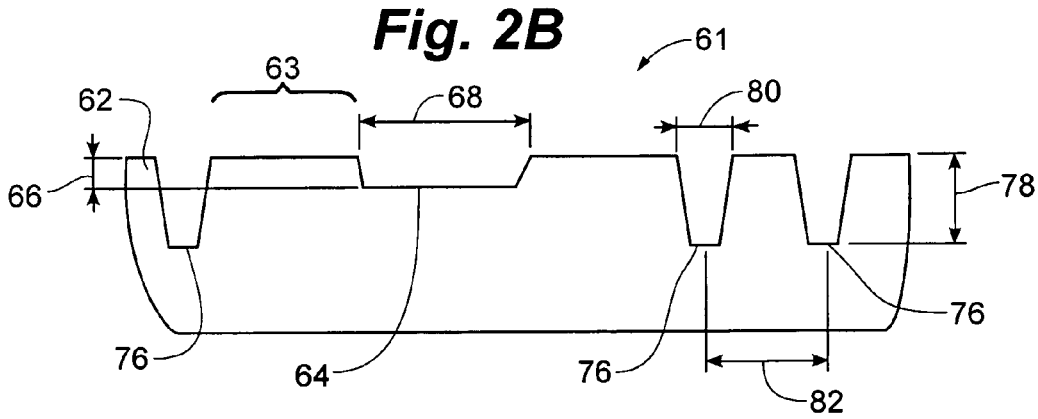
FIG. 2B is a fragmentary, transverse, cross-sectional view of a Gravure roll surface region having a shallow depression for printing a foreground logo pattern disposed between deep depressions for forming a repeating, background pattern of deeply penetrating bonding material in the web.

Referring now to FIG. 2B, another Gravure roll 61 is illustrated. Gravure roll 61 is similar to Gravure roll 60, but having a border region 63 about shallow depression 64 which differs from border region 65 of FIG. 2A. Gravure roll 61 has border region 63 not having the intermediate depth depression of Gravure roll 60 of FIG. 2A.

Figure 2C:
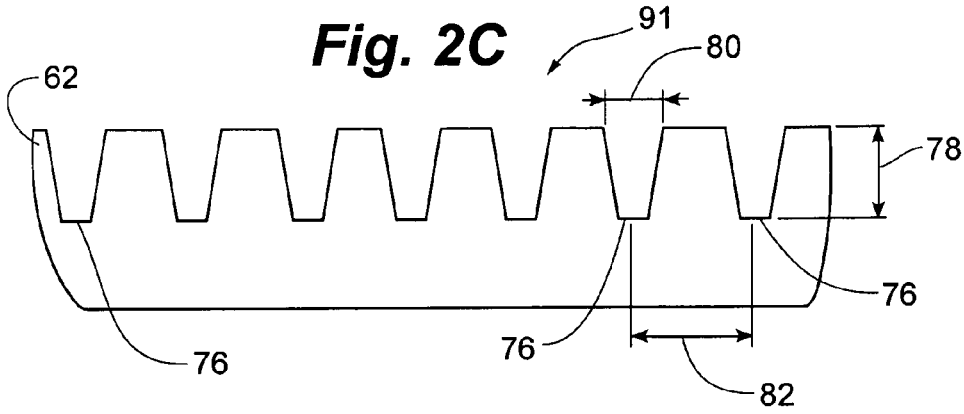
FIG. 2C is a fragmentary, transverse, cross-sectional view of a Gravure roll surface region for printing bonding material onto a web requiring only the background pattern, such as may be applied to the second surface of a paper web.

Referring now to FIG. 2C, yet another Gravure roll 91 is illustrated. Gravure roll 91 has features similar to the rolls of FIGS. 2A and 2B, but has only the background pattern associated with relatively deep depression 76 and not the shallow depression 64 or the intermediate depth depression 70. Roll 60 may be used to print the first surface of a paper web and roll 91 of FIG. 2C may be used to print the second, opposite surface of the web.

Figure 3:
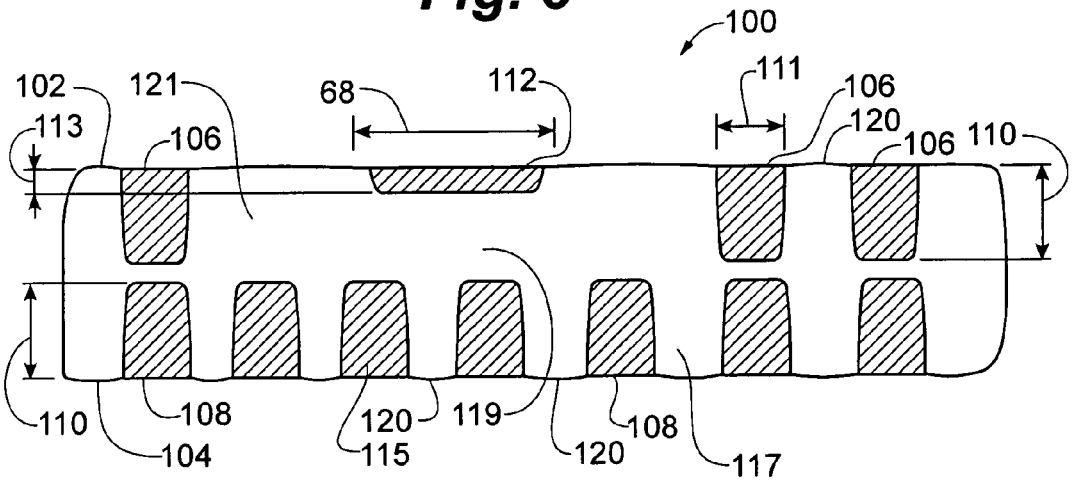
FIG. 3 is a fragmentary, highly diagrammatic, transverse, cross-sectional view of a paper web having bonding material applied to the a top surface by the Gravure roll of FIG. 2B, and having bonding material applied to the bottom surface by the Gravure roll of FIG. 2C.

Referring now to FIG. 3, a cross-section of a printed web 100 is illustrated having a first surface 102 and a second, opposite surface 104. Web 100 corresponds to the web having bonding material applied using the Gravure roll 61 of FIG. 2B on a first surface 102 and the Gravure roll 91 of FIG. 2C on a second surface 104. First surface 102 may be seen to have a regular pattern of high density, deeply penetrating bonding material regions 106 having a depth as indicated at 110 and a width as indicated at 111. Second surface 104 may be seen to have a series of deeply penetrating, high density bonding material background regions 108, which can also have a depth as indicated at 110. Bonding regions 106 and 108 may be referred to as high density, as within a section taken through the web, there is a higher sheet density due to the bonding material and fibers being held more closely together by the bonding material within the printed regions than in the unprinted regions. This is due in part to the lesser degree of expansion in the web thickness center regions having more deeply penetrating bonding material.

A relatively shallowly penetrating bonding material region 112 may be seen in FIG. 3, formed by shallow depression 64 of roll 61. The shallowly penetrating regions may be referred to as low density regions, as there is a lower sheet density of bonding material and fibers. Shallow penetrating bonding region 112 may be seen to have a width 68 substantially corresponding to the width of the Gravure roll shallow depression width. Shallow penetrating bonding region 112 may be seen to have a depth as indicated at 113. The depth 110 of deeply penetrating regions 106 may be substantially greater than the depth 113 of the shallow penetration region 112 in some embodiments. In one embodiment, depth 110 is deeper than about 150% shallower depth 113. In another embodiment, depth 110 is greater than about 200% of shallow depth 113.

Depth 110 is preferably between about 10% and 40% of the web thickness. In a preferred embodiment, where deep bonding material regions 106 and 108 are directly opposite each other on opposing sides of the web, the deep bonding material regions do not connect through the web. While FIG. 3 shows deep bonding regions 106 and 108 registered or aligned, this is not typically, intentionally, the case. As may be seen from FIG. 3, the regular, deeply printed background pattern regions 106 and 108 adds tensile strength to web 100. Shallowly penetrating logo region 112 may be seen to interrupt the deeply printed background patterns. Shallowly penetrating region 112, while having lower bonding material penetration than the background pattern regions, may nevertheless appear more visible, due to the large, continuous area relative to the narrower, albeit the deeper background bonding regions 106 and 108.

Inspection of FIG. 3 further shows a series of unprinted or non-printed regions 120 disposed between deeply penetrating regions 106 and 108. Non-printed regions 120 may have a width of about 1 mm on each surface in some embodiments. In one view of the invention, the contiguous, non-printed space within a single non-printed region 120 may be used as a basis of quantifying the non-printed area of a surface. In some embodiments, non-printed areas 120 are defined by the surrounding background pattern formed by deeply penetrating bonding regions 106 and 108. As may be seen from inspection of FIGS. 2A, 2B, and 2C, non-printed regions 120 correspond to substantially flat Gravure roll surface regions 92 disposed between deep depressions 76. As may also be seen from inspection of FIG. 3, the shallowly penetrating bonding area 112 is substantially larger than non-printed area 120. In one embodiment, shallowly bonded region 112 is at least about twice the average area of non-printed areas 120. In various other embodiments of the invention, shallow penetrating bonding region 112 is at least about 4, 8, and 10 times the size of the average non-printed region 120 defined by the background pattern.

Regions within the web thickness may now be discussed with respect to density after creping. Middle regions 119 and 121 are disposed within the web interior, midway between the two major surfaces, with region 119 being disposed under shallowly penetrating region 112, and region 121 being disposed near a deeply penetrating region. Another region is disposed well into the web, within a deeply penetrating region 108. Yet another region 117 is disposed well into the web in non-printed area 120. The fiber density in deeply printed region 115 will be high and that of region 117 low, due to the closely bound fibers and the relative lack of expansion or explosion during creping of region 115 relative to region 117. The fiber density of region middle regions 119 and 121 will both be high, as the creping greatly expands the middle portion of the web, whether disposed near shallowly printed areas or deeply printed areas.

Figure 4A:
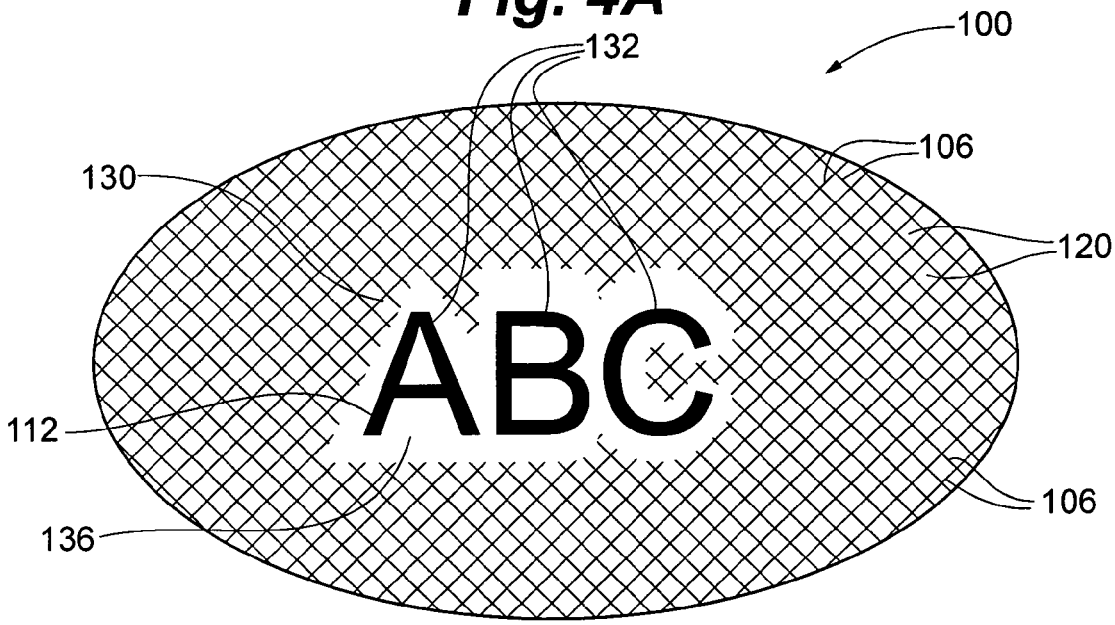
FIG. 4A is a highly diagrammatic, fragmentary, top view of a web having a deeply printed background pattern and a shallow logo printed in the foreground.

Referring now to FIG. 4A, a first surface 102 portion of the printed web 100 may be viewed from the top. Web 100 may be seen to have the deeply penetrating bonding background pattern formed by lines 106 and having non-printed regions 120 defined therebetween. A logo, trademark or other visually perceptible symbol 130 may be seen.

Logo 130 may be seen to be formed of individual letters "ABC" at 132, surrounded by an unprinted border 136. The letter "A" may be seen to be formed of shallow penetration bonding material region 112, as previously illustrated in FIG. 3. The contiguous surface areas formed by regions 112 are substantially larger than the non-printed regions 120 defined between the regularly repeating background pattern, deeply printed regions 106. Viewed alternatively, the repeating patterns formed by the background patterns 106 may be polygons, squares, rectangles, oval, or diamonds, forming the smallest repeating units of the background in FIG. 4A. These polygons each define an area that is substantially less than the surface area formed by the shallow penetration bonding regions, for example, forming any of the letters A, B, or C. This large contiguous area enhances visibility despite the shallow bonding depth. Moreover, the enhanced visibility of regions 112 is not at the expense of tensile strength. As used herein, "contiguous" means a substantially unbroken area as viewed with the unaided eye. In one example, the block printed letters "ABC" may have three contiguous areas, one within each letter.

The regular, repeating background regions 106 add tensile strength to the web by bonding a high percentage of papermaking fiber crossovers. That is, the local density of this background pattern are such that fiber crossovers are bonded to add tensile strength. Regions 112 do not penetrate the web as deeply as regions 106. Accordingly, fiber crossovers in regions 112 are not bonded to the same depth as in regions 106. This potential loss of tensile strength is mitigated, however, by the increased surface area bonded in regions 112. That is, surface crossovers are bonded in regions 112 to make up for the loss of tensile strength resulting from the deeper crossovers being left unbonded in regions 112. Although regions 112 cover a larger percentage of surface area, since regions 112 are relatively shallower, they do not add undue stiffness to the web.

While the shallowly printed regions may be useful for forming visually recognizable patterns, or logos, in some embodiments, there inclusion has a major structural effect. Just as the deeply printed background pattern has a structural effect. The background pattern is present not primarily for aesthetics, but for adding strength, bulk, and softness. The strength of bonding the web is a polymeric material is self evident. The bonding material also adds bulk and softness due in large part to the creping action. In particular, the bonding material can bind to the creping drum, to be creped off, greatly expanding the middle thickness of the web. Bulk and softness is increased due to the interaction of the bonding material and the creping drum and blade. The shallowly printed regions also adhere to the creping drum, and expand the web thickness as well. The shallowly printed regions, which may not have a regular pattern of unprinted regions within, can thus have different printed web properties. In particular, the same amount of bonding material present overall in a large background area can be spread out more evenly in the shallowly printed area, leaving a more of the web thickness unpenetrated, having greater capacity for expansion at the creping roll.

Figure 4B:
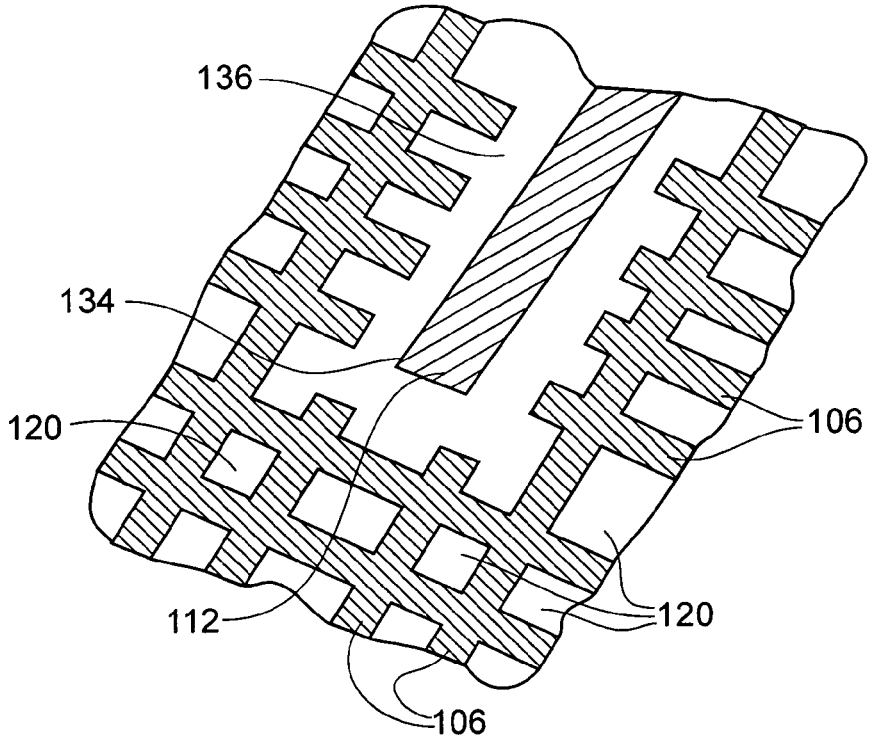
FIG. 4B is a magnified, detailed view of a portion of the letter A of FIG. 4A, illustrating the background pattern and the foreground logo pattern in one embodiment.

Referring now to FIG. 4B, a leg portion 134 of the letter "A" may be seen as indicated at 134. Region 134 is a shallow bonding material penetration region 112 as previously discussed. The contiguous, shallow penetration region 112 is preferably substantially larger than the non-printed region 120 defined between background, deeply penetrating bonding regions 106. A border region 136 may be seen about shallow penetration bonding material region 134.

Figure 4C:
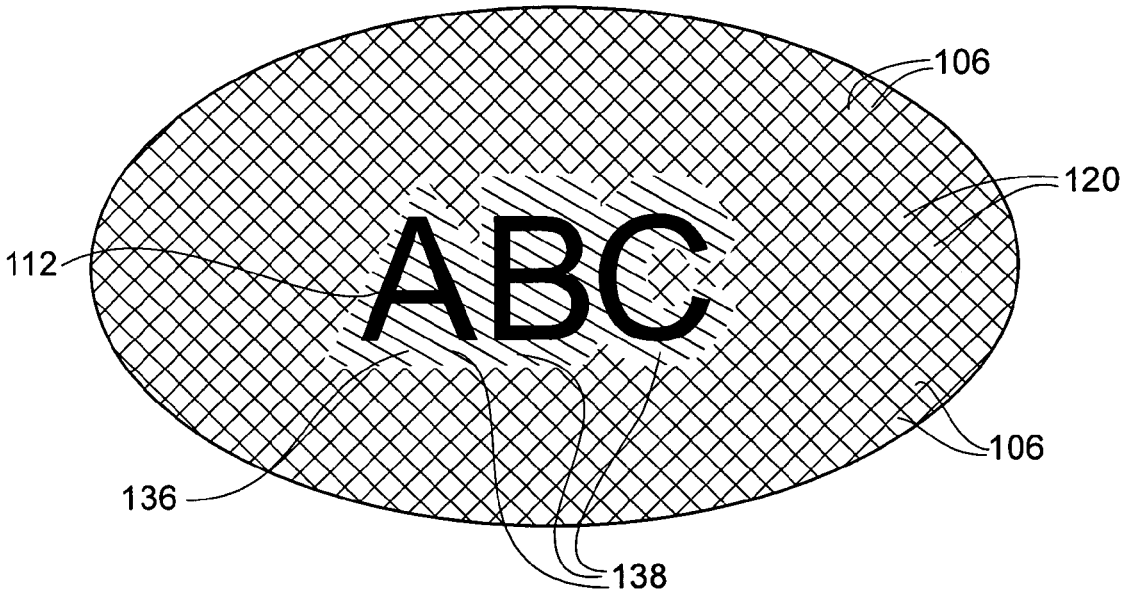
FIG. 4C is a view similar to the view of FIG. 4A, but having an intermediate depth bonding material stippling applied in the border region about the logo.
Figure 4D:
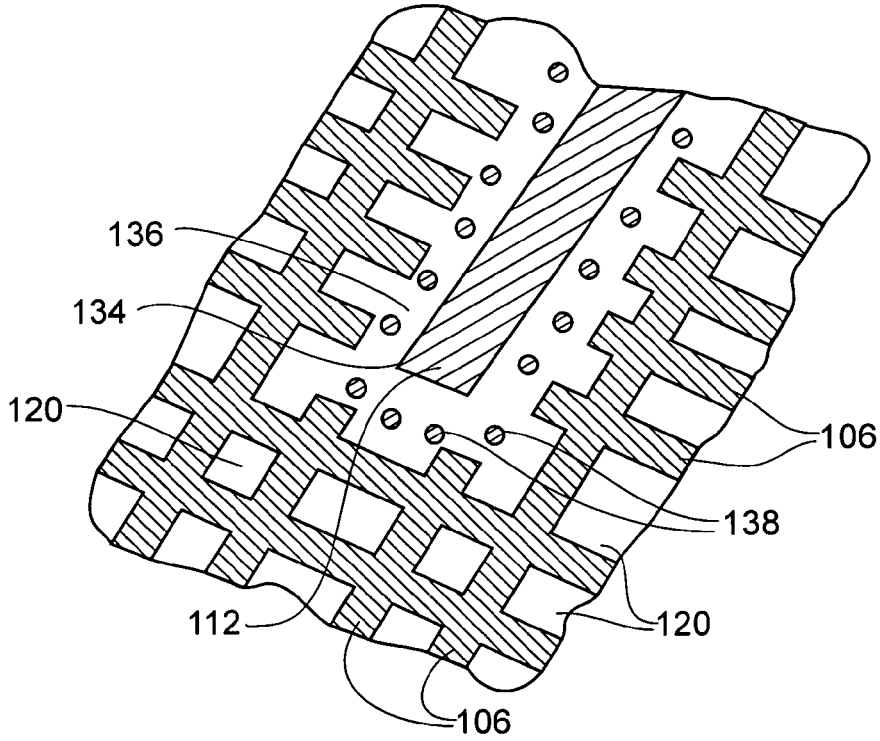
FIG. 4D is a view similar to that of FIG. 4B, but having intermediate depth bonding material stippling within the border region about the shallow depth logo pattern.

Referring now to FIGS. 4C and 4D, another embodiment of the invention is illustrated. In this embodiment, shallow penetration bonding material region 112 may be seen to include a border 136, as previously illustrated in FIGS. 4A and 4B. In this embodiment, however, border region 136 has an intermediate depth bonding material penetration including a plurality of intermediate penetrating depth stippling marks 138. Stippling marks 138 form a different border region about the logo which can be used to provide an intermediate region of strength about the visible indicia or logo.

Figure 5:
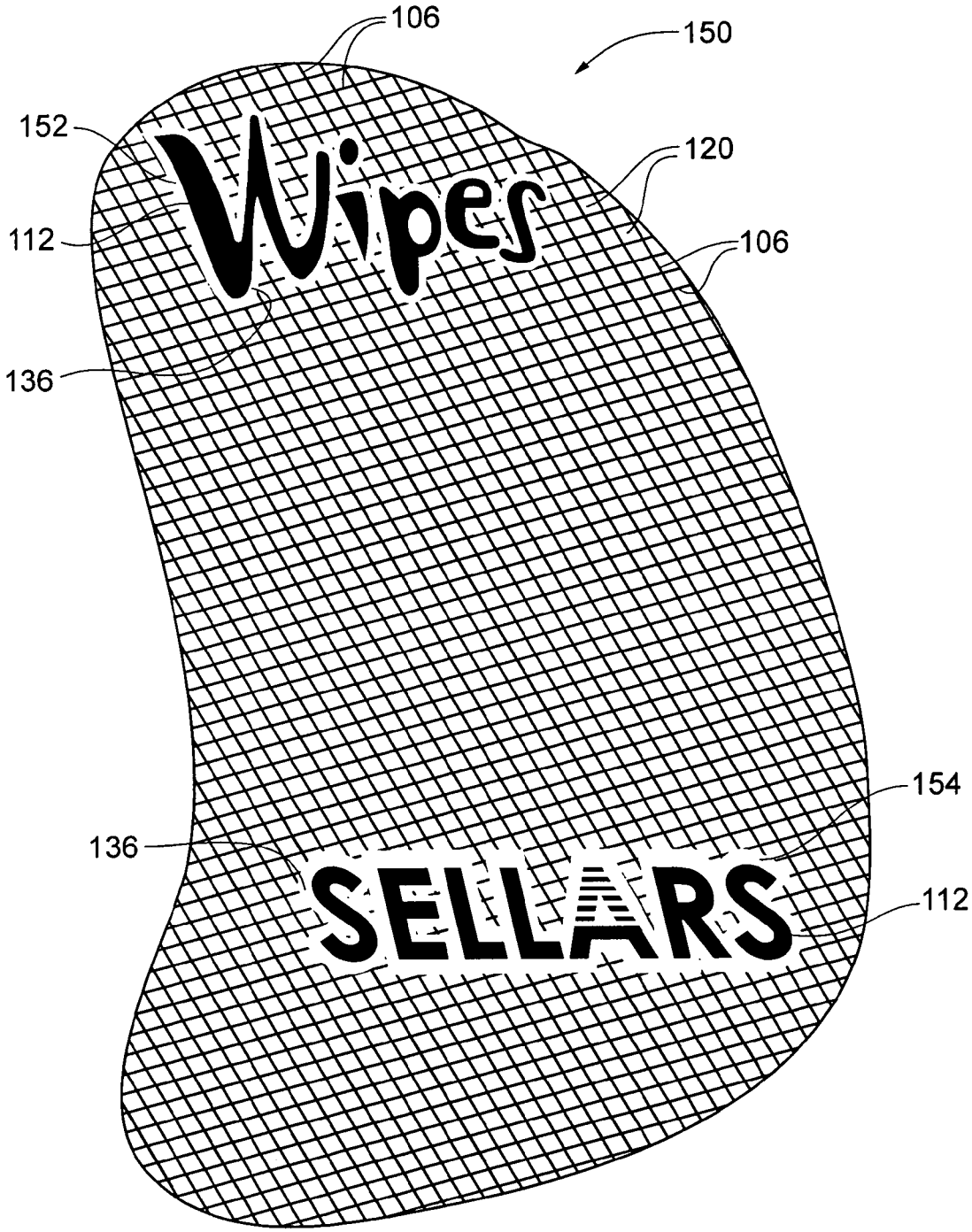
FIG. 5 is a fragmentary, top view of a paper web having bonding material applied in a first background pattern and having a logo applied in the foreground as a second pattern of bonding material.

Referring now to FIG. 5, another printed web 150 according the present invention is illustrated. Web 150 may be seen to have applied thereon a background pattern formed by deeply penetrating bonding material regions 106 as previously discussed. Non-printed regions 120 may also be seen, as previously discussed. A first logo 152 may be seen, as may a second logo 154 (i.e., the assignee of the present invention). Both logos may be seen to include the shallow bonding material penetrating region 112 and a border 136, as previously discussed. Logos 152 and 154 may be seen to indicate both a product name and a company name. In general, the present invention may be used to advertise or promote the trademarks, service marks, product names, or other messages desiring promotion.

Figure 6:
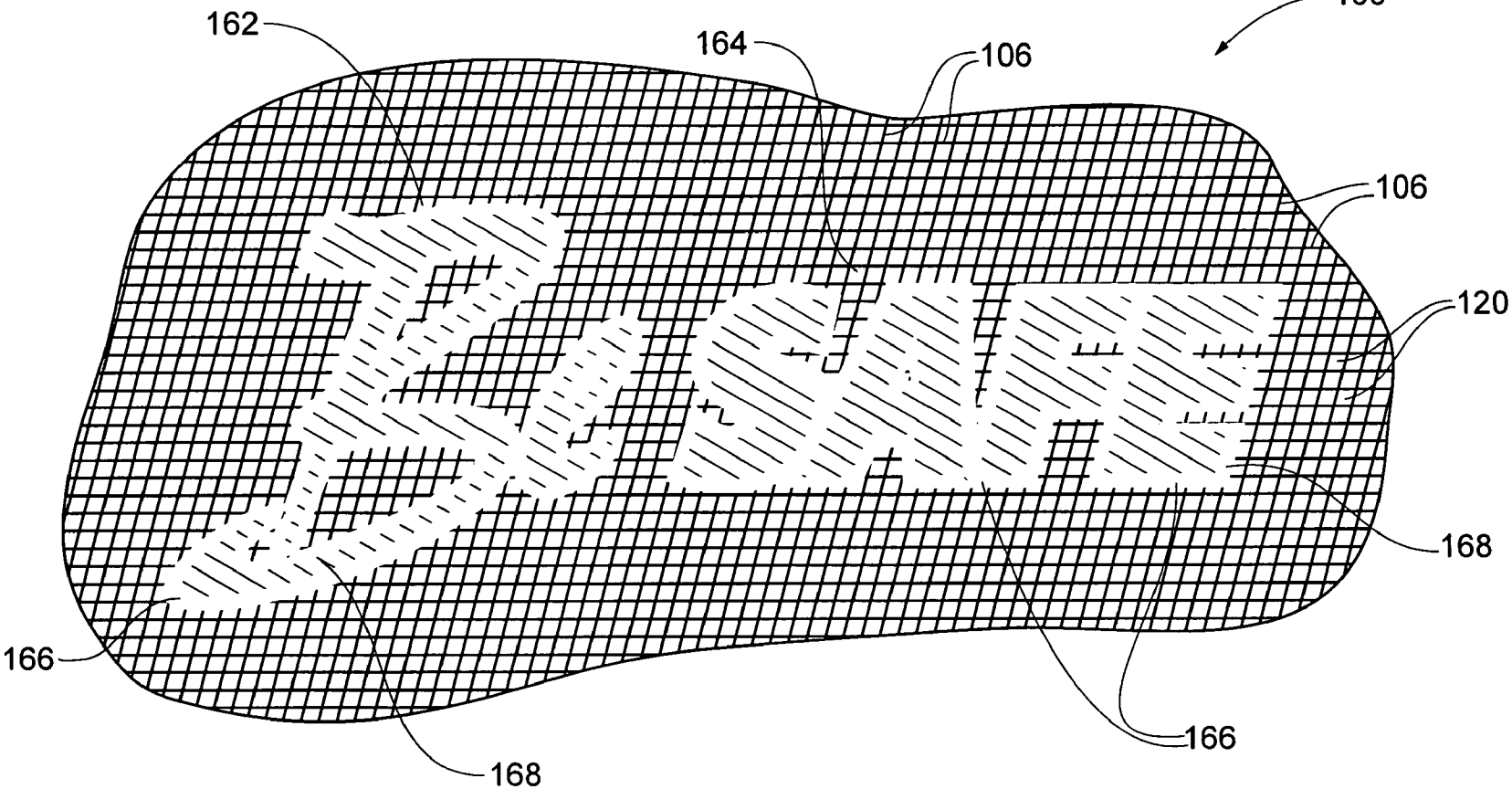
FIG. 6 is a fragmentary, top view of a paper web printed with bonding material having a message promoting safety formed as a deeply printed pattern formed within non-printed borders formed within a deeply printed background.

Referring now to FIG. 6, another printed web 160 according to the present invention is illustrated. Web 160 includes a logo formed of a first word 162 and a second word 164. Word 162 and 164 may be seen to include individual letters 166 therein. Letters 166 may be seen to be included with a substantially non-printed border region 168. In this embodiment, however, letters 166 are formed of deep penetrating bonding material lines. Letters 166 may have a similar depth of penetration of bonding material as background pattern lines 106. The lines in the deep penetration regions forming letters 166 may, however, be offset with respect to angle with respect to lines 106 forming the background pattern, in order to better set off the letters from the background pattern.

FIG. 6 thus illustrates web 160 having visibly recognizable indicia, such as logos or trademarks formed by deeply printed bonding regions formed into symbols set off from deeply printed background regions by a non-printed border region. The deeply printed background and deeply printed logo regions may, in some embodiments, have substantially the same depth of bonding material penetration and of corresponding Gravure roll depressions. FIG. 6 also illustrates another use of the present invention. Specifically, webs according to the present invention can be used to promote desirable employee behavior by printing reminders of desired behavior on disposable wipe products. In the example of FIG. 6, safety is promoted by printing a safety slogan on the disposable wipe. This may be of particular use in industrial wiping applications. The desired activities or behaviors may be supplied by either the web manufacturers or by the purchasers.

Figure 7:
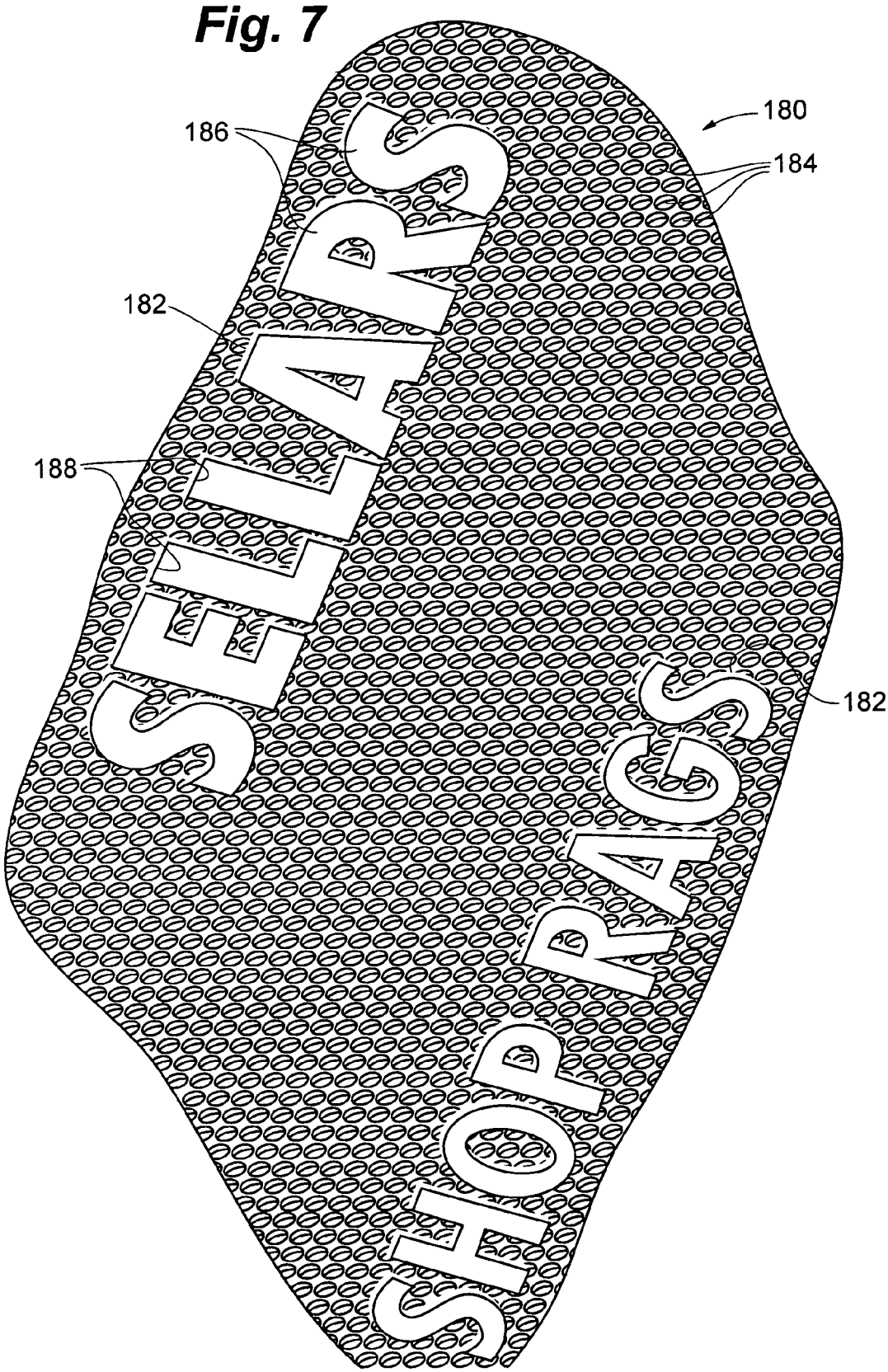
FIG. 7 is fragmentary, top view of a web imprinted with a background pattern, having a logo formed essentially as a non-printed area within the background pattern.

Referring now to FIG. 7, another embodiment of the invention is illustrated. FIG. 7 illustrates another printed web 180 having a regular, geometrically repeating background pattern 184 having defined corresponding non-printed regions within. A logo 182 may be seen formed on web 180. Individual letters or symbols 186 may be seen to make up logo 182. In this embodiment, letters 186 may be seen to be formed substantially of non-printed contiguous areas. In one embodiment, letters 186 are formed of contiguous, non-printed regions bounded by printed outline regions 188 to better define and set off the letters. Web 180 of FIG. 7 may be made by using a Gravure roll having a regular repeating background pattern in all areas but the regions reserved for letter formations. The Gravure roll may also have depressions engraved or etched in the roll surface to better outline the letters thus formed.

Figure 8:
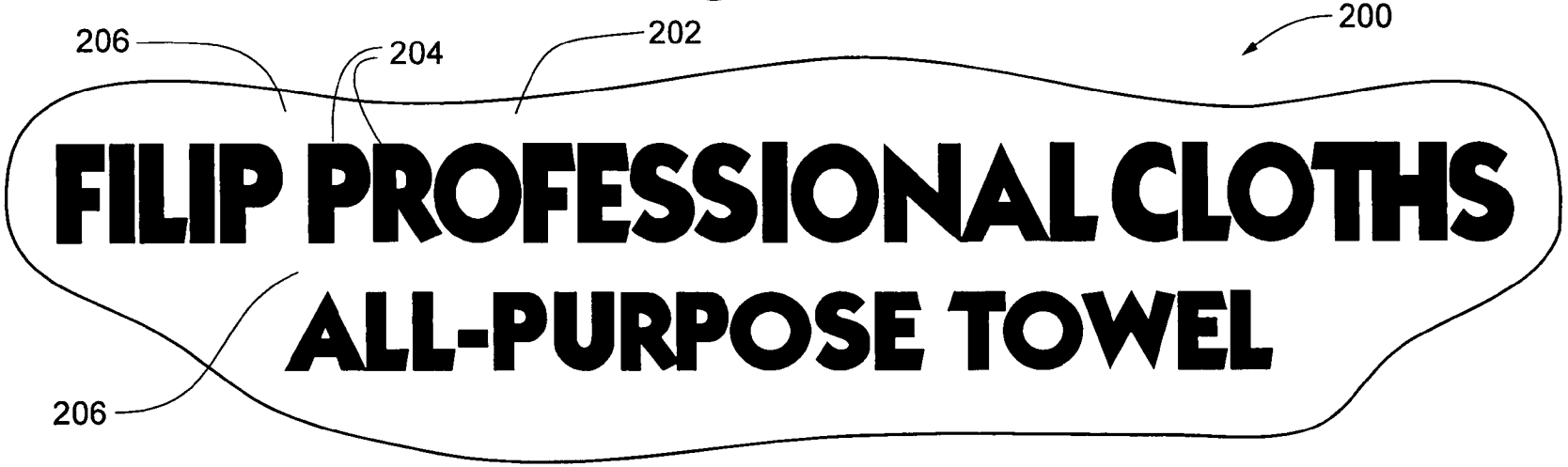
FIG. 8 is a fragmentary, top view of a paper web having a logo imprinted as a high or low density pattern having a non-printed background.

FIG. 8 illustrates yet another printed web 200 having a logo 202 formed of a plurality of individual letters 204 surrounded by a substantially greater non-printed background area 206. Web 200 may be used in applications requiring less strength and/or more absorbency. In some embodiments, a web such as illustrated in FIG. 8 may incorporate stronger fibers and/or other strengthening mechanisms to compensate for the lack of bonding material in the majority of the web surface.

The bonding material may be any suitable bonding material, well known to those skilled in the art. A latex based, opaque, pigment containing, bonding material is used in a preferred embodiment. The bonding material preferably has a colored pigment having a different color than the web material. While the pigment color could be white, other colors are preferred. In one embodiment, in areas consisting only of background printing, the deeply penetrating bonding material covers about forty percent of the web surface, the remainder being unprinted background space. In another embodiment, in contiguous areas consisting only of logo printing, the shallowly penetrating bonding material covers about one hundred percent of the web surface within these contiguous areas.

Methods of doing business are also within the scope of the present invention. One method includes advertising a product or service of a business entity or other organization by printing a trademark of that business entity or other organization on the disposable bonded and creped absorbent paper web product. The printed paper web product can then be sold to the business entity, other organization, or to a third party. The printed paper web may have printed on it a symbol representing a product or service of that business entity. The symbol can be a trademark, service mark, or other visibly discernable indicia or logo representing that product, service, or business entity.

In one business method according to the present invention, a slogan is obtained which promotes desirable employee activity. The slogan thus obtained is printed using bonding material onto the first surface of a paper web, thereby forming a printed paper web product. The printed paper web product thus formed can be sold to a business entity to promote the desirable employee activity. In one method, the slogan promotes safety.

In another business method according to the present invention, a design for advertising a product or service of an entity is obtained. A disposable, bonded and creped type paper web is made having the design displayed thereon using the bonding material. The printed paper web is then sold. The paper web may be sold to the business entity. In some methods, the design is a trademark of the entity. In other methods, the design includes a logo having text representing a product or service of the entity. In one method, a trademark or service mark of the entity is reproduced in text at least as part of the design on the printed web. In another method, the trademark is represented as an unprinted area on the disposable bonded and creped absorbent paper web product. In yet another method, the trademark is represented as a bonding material low penetration region printed within a repeated geometric pattern of higher penetration pattern. The higher penetration region can form a background about the lower penetration region representing the trademark. In a preferred method, the printed bonding material region has an average contiguous printed area at least about four times that of the unprinted region defined by the high density printed background.

What is claimed is:

1. A bonded and creped absorbent paper web comprising:

a first surface having a repeating geometric background first pattern of a bonding material having a first penetration depth, and a second pattern of the bonding material being surrounded by the background pattern and having a second penetration depth, the first pattern defining a repeating, unprinted web region therebetween having-a repeating-unprinted region with an average surface area, the second pattern having an average contiguous surface area of at least twice the repeating unprinted region average surface area, and the first pattern having a bonding material penetration depth of at least 150% of the second pattern bonding material penetration depth.

2. A bonded and creped absorbent paper web as in claim 1, wherein the second pattern has an average contiguous area of at least about four times the unprinted region average area, wherein the web has a second surface also having a repeating geometric first background printed thereon including the bonding material.

3. A bonded and creped absorbent paper web as in claim 1, wherein the second pattern forms a visually recognizable symbol.

4. A bonded and creped absorbent paper web as in claim 1, wherein the second pattern includes letters.

5. A bonded and creped bonding material as in claim 1, wherein the second patterns are substantially surrounded by a border region of unprinted web material, the border region being surrounded by the repeating background pattern.

6. A bonded and creped absorbent paper web as in claim 1, wherein the second pattern is substantially surrounded by a border region, the border region being surrounded by the repeating background pattern, wherein the border region has a bonding material penetration depth less than the first pattern bonding material penetration depth and greater than the second pattern bonding material penetration depth.

7. A bonded and creped absorbent paper web as in claim 1, wherein the bonding material includes a latex material.

8. A bonded and creped absorbent paper web as in claim 1, wherein the background pattern forms an essentially contiguous path across the web first surface, the path having the unprinted regions therewithin.

9. A bonded and creped absorbent paper web as in claim 8, wherein the background pattern includes a first set of parallel lines and a second set of parallel lines intersecting the first set of parallel lines, so as to form unprinted regions bounded on four sides by the first and second intersecting lines.

10. A bonded and creped absorbent paper web as in claim 9, wherein the unprinted regions have a polygon shape.

11. A bonded and creped absorbent paper web as in claim 10, wherein the unprinted regions have a substantially square or rectangular shape.

12. A method of making a bonded absorbent paper web, the method comprising the steps of:

providing a paper web having a first surface and a second surface;

providing a Gravure roll that has a plurality of deep roll depressions surrounding a plurality of non-printing roll regions, the roll further having a plurality of shallow roll depressions;

providing a bonding material; and printing the bonding material into the web first surface by pressing the Gravure roll and bonding material against the web first surface, such that a background pattern having a deep penetration into the web is formed by the roll deep depressions, and a plurality of unprinted web regions are formed by the flat non-printing roll regions, and a plurality of logo patterns are formed having a shallow penetration into the web, wherein the logo patterns have an average contiguous area size that is at least about two times the average repeating unprinted area size, wherein the Gravure roll deep depressions have a penetrating depth of at least about 150% the penetrating depth of the roll shallow depressions.

13. A method as in claim 12, wherein the web logo average contiguous area is at least about four times the average web unprinted region areas.

14. A method as in claim 12, wherein the web logo average contiguous area is at least about eight times the average web unprinted region areas and the logo area includes a visually recognizable symbol.

15. A method as in claim 14, wherein the visually recognizable symbol includes letters.

16. A method as in claim 12, wherein the web deep penetrating regions cover between about 10 and 50% of the web first surface.

17. A method as in claim 12, wherein the web shallow penetrating average areas cover less than about 20% of the web first surface.

18. A method as in claim 12, wherein the Gravure roll deep roll depressions have a depth that is at least about 60 microns.

19. A method as in claim 12, wherein the Gravure roll shallow roll depressions have a depth of between about 55 microns and about 125 microns.

20. A method as in claim 12, wherein the Gravure roll shallow roll depressions have a depth of between about 30 and about 100 microns therein.

21. A method as in claim 12, wherein the web logo patterns are substantially surrounded by an unprinted web border region having essentially no bonding material therein.

22. A method as in claim 12, wherein the web logo pattern is substantially surrounded by a border region having an intermediate bonding material penetration depth pattern, wherein the intermediate penetration depth pattern has a depth of bonding material into the web of less than the background regions and greater than the logo regions.

23. A method as in claim 12, wherein the web background regions have a bonding material penetration of at least about 100% of the bonding material penetration of the web logo patterns.

24. A method as in claim 12, wherein the web background patterns have a bonding material penetration of between about 150% to about 400% of the bonding material penetration of the logo regions.

25. A method as in claim 12, wherein the method further comprises printing a repeating geometric background pattern on the second surface of the paper web.

26. A bonded and creped absorbent paper web comprising:

a first surface having a repeating geometric background first pattern of a bonding material having a first penetration depth, and a second pattern of the bonding material being surrounded by the background pattern and having a second penetration depth, the first pattern defining a repeating, unprinted web region therebetween having a repeating-unprinted region average surface area, the second pattern having an average contiguous surface area of at least twice the unprinted region average surface area, and the first pattern having a bonding material penetration depth greater than the second pattern bonding material penetration depth.

27. A method of making a bonded absorbent paper web, the method comprising the steps of:

providing a paper web having a first surface and a second surface;

providing a Gravure roll that has a plurality of deep roll depressions surrounding a plurality of non-printing roll regions, the roll further having a plurality of shallow roll depressions;

providing a bonding material; and printing the bonding material into the web first surface by pressing the Gravure roll and bonding material against the web first surface, such that a background pattern having a deep penetration into the web is formed by the roll deep depressions, and a plurality of repeating unprinted web regions are formed by the flat non-printing roll regions, and a plurality of logo patterns are formed having a shallow penetration into the web, wherein the logo patterns have an average contiguous area size that is at least about two times the average repeating unprinted area size, wherein the Gravure roll deep depressions have a penetrating depth greater than the penetrating depth of the roll shallow depressions.

* * * * *